US011542941B2

(12) United States Patent
Weatherley

(10) Patent No.: US 11,542,941 B2
(45) Date of Patent: Jan. 3, 2023

(54) PUMP APPARATUS

(71) Applicant: TCS Micropumps Limited, Faversham (GB)

(72) Inventor: Richard Weatherley, Faversham (GB)

(73) Assignee: TCS Micropumps Limited, Faversham (GB)

( * ) Notice: Subject to any disclaimer, the term of this patent is extended or adjusted under 35 U.S.C. 154(b) by 0 days.

(21) Appl. No.: 16/970,421

(22) PCT Filed: Feb. 15, 2019

(86) PCT No.: PCT/GB2019/050413
§ 371 (c)(1),
(2) Date: Aug. 17, 2020

(87) PCT Pub. No.: WO2019/158935
PCT Pub. Date: Aug. 22, 2019

(65) Prior Publication Data

US 2021/0108635 A1 Apr. 15, 2021

(30) Foreign Application Priority Data

Feb. 16, 2018 (GB) ..... 1802587

(51) Int. Cl.
*F01C 19/00* (2006.01)
*F03C 2/00* (2006.01)
(Continued)

(52) U.S. Cl.
CPC ..... *F04C 15/0023* (2013.01); *F04C 5/00* (2013.01)

(58) Field of Classification Search
CPC . F04C 2/3446; F04C 15/0023; F04C 5/00–08
See application file for complete search history.

(56) References Cited

U.S. PATENT DOCUMENTS 2,462,214 A * 2/1949 Namur ..... F04C 2/3441 418/257
2,971,469 A 2/1961 McLean
(Continued)

FOREIGN PATENT DOCUMENTS

CN 201943947 8/2011
CN 103603799 2/2014
(Continued)

OTHER PUBLICATIONS

CN103603799A—Cai Naixin; Xu Jiyong—Fuel feeding pump for heavy engineering machinery—Feb. 26, 2014—The Machine English Translation. (Year: 2014).*
(Continued)

*Primary Examiner* — Theresa Trieu
(74) *Attorney, Agent, or Firm* — Haugen Law Firm PLLP

(57) ABSTRACT

A pump apparatus includes a pump chamber having a fluid inlet and a fluid outlet and a flexible impeller mounted for rotation within the pump chamber. The flexible impeller includes a plurality of radially extending vanes to contact a curved wall of the pump chamber, such that separate pump cavities are defined between adjacent vanes and the pump chamber wall. The fluid inlet and the fluid outlet are defined in the second end wall so that the curved pump chamber wall is uninterrupted.

12 Claims, 4 Drawing Sheets

(51) Int. Cl.

| | |
|---|---|
| ***F03C 4/00*** | (2006.01) |
| ***F04C 15/00*** | (2006.01) |
| ***F04C 5/00*** | (2006.01) |

(56) References Cited

U.S. PATENT DOCUMENTS 3,053,190 A * 9/1962 Carlson ..... F04C 5/00 418/154
3,240,154 A * 3/1966 Robbins ..... F04C 15/00 418/135
3,309,965 A * 3/1967 Weickgenannt ..... F04C 15/06 418/133
3,552,895 A * 1/1971 Bayley ..... F04C 18/344 418/178
3,694,114 A * 9/1972 Eickmann ..... F04C 15/0023 418/132
5,449,280 A * 9/1995 Maki ..... F04C 5/00 418/154
5,697,773 A * 12/1997 Mendoza ..... F01C 1/44 418/236
2010/0064718 A1* 3/2010 Blomquist ..... F01C 1/0809 418/268
2014/0105776 A1* 4/2014 Ellero ..... F04C 15/0046 418/191

FOREIGN PATENT DOCUMENTS

| | | |
|---|---|---|
| DE | 3340541 | 5/1985 |
| EP | 2639456 | 9/2013 |
| GB | 721319 | 1/1955 |
| JP | H06288357 | 10/1994 |

OTHER PUBLICATIONS

International Search Report and Written Opinion in International Application Serial No. PCT/GB2019/050413 dated Sep. 6, 2019.
Search Report in British Application No. GB1802587.4 dated Aug. 16, 2018.

* cited by examiner

PUMP APPARATUS

FIELD OF THE INVENTION

The present invention relates to a pump apparatus, in particular to a positive displacement pump apparatus.

BACKGROUND OF THE INVENTION

Pumps for pumping relatively viscous liquids tend to require multiple bearings and dynamic seals for the drive shaft of the pump. These can wear relatively quickly, typically requiring the pump to be replaced. In addition, these additional components add to the complexity and cost of the pump.

It is desired to provide a pump which has a simpler design that requires fewer components.

SUMMARY OF THE INVENTION

According to a first aspect of the invention, there is provided a pump apparatus comprising a pump chamber having a fluid inlet and a fluid outlet; and a flexible impeller mounted for rotation within the pump chamber, wherein the pump chamber is defined by a curved wall, the wall including a first wall portion having a first radius and a second wall portion having a second radius, wherein the second radius is greater than the first radius; the flexible impeller includes a plurality of radially extending vanes, wherein the vanes contact the curved wall of the pump chamber such that separate pump cavities are defined between adjacent vanes and the pump chamber wall; the flexible impeller is driven to rotate by a drive shaft; the drive shaft passes through a first end wall which closes one side of the pump chamber and a distal end of the drive shaft rotates within a bearing defined by a second end wall which closes the opposite side of the pump chamber; and wherein the fluid inlet and the fluid outlet are defined in the second end wall.

The skilled person will appreciate that the pump is based on a known flexible impeller pump in which a number of flexible pump cavities are defined between adjacent vanes and the pump chamber wall. The volume of the pump cavities decreases as the impeller moves from the first wall portion to the second wall portion, which in turn forces the fluid located within the pump cavity out of the cavity and through the fluid outlet.

The term "flexible" refers to the radially extending vanes which are deflected by contact with wall of the pump chamber. The radially extending vanes may be resiliently deformable.

By defining the fluid inlet port and the fluid outlet port in the second end wall, the curved wall of the pump chamber can be formed as a continuous, uninterrupted surface. This further allows the curved wall of the pump chamber to be formed from a separate sleeve. Thus, the second end wall defines a fluid inlet port, a fluid outlet port and the bearing portion which is configured to receive the distal end of the drive shaft.

Suitably, the centre point of the first wall portion radius is co-axially aligned with the centre of the pump chamber and the drive shaft for the flexible impeller. However, the centre point for the second wall portion radius may be spaced from the centre point of the first wall portion and may even lie outside of the pump chamber. In this way, the second wall portion is effectively a flattened portion of the curved pump chamber wall which reduces the volume of the pump cavities as they rotate against the second wall portion.

The bearing defined by the second end wall is suitably a closed bearing. In other words, the bearing may define a cylindrical aperture which is open at one end to receive the distal end of the drive shaft and is closed at its opposite end. In this way, the drive shaft does not extend through the second end wall. Such an arrangement avoids the need for a seal to be provided within the bearing, as no liquid can leak from the bearing. Additionally, a closed bearing may further function as a thrust bearing, which prevents or limits axial motion of the drive shaft.

The drive shaft for such pumps typically requires one or more bearings and dynamic seals at its proximal end and the distal end of the drive shaft is arranged to be free-floating. However, it has been found that by forming a bearing in the second end wall (i.e. at the distal end of the drive shaft), the shaft only requires a single bearing arrangement and seal at its proximal end.

The second end wall may be formed from a bearing material such that the distal end of the drive shaft is able to rotate within the bearing portion without the need for any further bearing components. This is advantageous when pumping food products, as the absence of bearing components makes the cleaning of pump apparatus easier. The second end wall is suitably formed from a polymeric material that is capable of functioning as a bearing material, such as for example, PTFE.

For ease of manufacture, the curved wall of the pump chamber may be formed from a sleeve. In this way, the sleeve may simply be replaced in the event that it becomes worn or if different pumping characteristics are required. The sleeve suitably fits within a pump body in use. Thus, the sleeve may comprise an outer wall having a circular cross section and the pump body may define an inner wall having a circular cross section, wherein the diameter of the outer wall of the sleeve is substantially the same as the diameter of the inner wall defined by the pump body.

As noted above, the formation of the inlet port and the outlet port in the second end wall permits the use of a sleeve to define the curved wall of the pump chamber.

In embodiments in which the sleeve is formed from a relatively soft material, it may not be necessary to include any sealing elements between the sleeve and the pump body and/or the end walls of the pump apparatus. This is useful in embodiments in which the pump is used to pump food products and it is necessary to thoroughly clean the pump from time to time, as the absence of sealing elements avoids or minimises locations in which bacteria can build up.

However, in embodiments in which the liquid to be pumped is relatively viscous, the impeller may be formed from a stiffer material and sleeve may also be formed from a stiffer material. In such embodiments, it may be necessary to include one or more sealing elements between the sleeve and the end walls of the pump apparatus.

Pumps according to the invention are driven by motors, typically electric motors, and it is often desired to couple the pump directly to a motor (e.g. an electric motor). In such embodiments, the pump apparatus further includes a connector which connects the pump apparatus to a motor.

The connector suitably also defines the first end wall. In this way, a minimum number of components are required. Thus, the drive shaft passes through the first end wall and into a cavity defined by the connector. The proximal end of the drive shaft may be coupled with an output shaft from the motor within the cavity defined by the connector. In embodiments in which the proximal end of the drive shaft is coupled to the output shaft from the motor, the proximal end of the drive shaft may include a first part of a two part coupling. A second part of the two part coupling is suitably carried by the output shaft of the motor.

According to a second aspect of the invention, there is provided a combination of a pump apparatus according to the first aspect of the invention as defined herein and an electric motor, wherein a rotary drive output from the electric motor is coupled to the drive shaft of the pump apparatus.

In an embodiment of the invention, one of the output shaft from the electric motor and the drive shaft of the pump apparatus includes a first part of a two-part connector and the other of the output shaft from the electric motor and the drive shaft of the pump apparatus includes a second part of the two-part connector.

In order to make the coupling of the two parts of the two-part connector easier, the two-part connector is suitably self-aligning. For example, the first part of the two-part connector may include a rib and the second part of the two-part connector may include a channel having sloped sides, such that the sides of the channel guide the rib into the channel. In a further embodiment, the two-part connector may include more than one rib and a corresponding number of channels. For example, the two-part connector may include three ribs and three channels having sloped sides. The channels may be arranged radially about a central axis. In this way, the angular orientation of the ribs relative to the channels does not matter, as the sloping sides of the channels will cause the shaft which carries the ribs to rotate until the ribs are aligned with the channels and the first part of the two-part connector is coupled to the second part of the two-part connector.

The pump apparatus of the second aspect of the invention is operatively coupled to an electric motor. The pump apparatus may be connected directly to the electric motor, for example via a connector which forms part of the pump apparatus, wherein the electric motor is secured to the connector; or the pump apparatus may be indirectly connected to the electric motor. In such embodiments, the pump apparatus may be connected to the electric motor via one or more intermediate components. Thus, the pump apparatus and the electric motor may form a single unit or the pump apparatus may be operatively connected to, but spaced from the electric motor.

According to a third aspect of the invention, there is provided a pump apparatus including a pump body and a pump receiver configured to receive the pump body, wherein the pump body defines a pump chamber having a fluid inlet and a fluid outlet; a pump element which urges the fluid to flow from the inlet to the outlet; and at least one permanent magnet; wherein the pump receiver includes at least one permanent magnet; and wherein the pump body has a first orientation relative to the pump receiver in which the magnets are aligned and pump body is coupled to the receiver via an attractive magnetic force, and a second orientation relative to the pump receiver in which the magnets are out of alignment and the pump body is detachable from the pump receiver.

The pump body of the third aspect of the invention is secured to a pump receiver via a magnetic attraction. When the magnets are aligned, the pump body is securely fixed to the pump receiver. However, it can readily be removed from the pump receiver simply by moving the pump body and/or the pump receiver such that the pump body is in its second orientation relative to the pump receiver and the magnets are out of alignment. This is useful in cases in which the pump body needs to be removed periodically for cleaning or replacement.

The pump receiver may form part of a motor, such as an electric motor, or it may form an intermediate component between the pump body and the motor.

The pump body of the third aspect of the invention may be any positive displacement pump apparatus. However, in an embodiment of the invention, the pump body of the third aspect of the invention comprises a pump apparatus according to the first aspect of the invention (i.e. a flexible impeller pump). Thus, the pump apparatus of the first aspect of the invention may include at least one permanent magnet. In such embodiments, the pump body of the third aspect of the invention may include any of the features as defined and described herein in connection with the first aspect of the invention.

According to an embodiment of the invention, the pump receiver includes two spaced apart permanent magnets, wherein in the first orientation, the pump body magnet is aligned with a first one of the pump receiver magnets, the poles are opposite and an attractive force is generated between the magnets; and in the second orientation, the pump body magnet is aligned with a second one of the pump receiver magnets, the poles are the same and a repulsive force is generated between the magnets which urges the pump body away from the pump receiver.

Alternatively, the pump body may include two spaced apart permanent magnets, wherein in the first orientation, the pump receiver magnet is aligned with a first one of the pump body magnets, the poles are opposite and an attractive force is generated between the magnets; and in the second orientation, the pump receiver magnet is aligned with a second one of the pump body magnets, the poles are the same and a repulsive force is generated between the magnets which urges the pump body away from the pump receiver.

In both of the embodiments defined above, the pump receiver magnet(s) may be carried by a rotatable collar which can be rotated between the first and second orientations. Alternatively, the pump body may be rotatable relative to the pump receiver between the first and second orientations.

In a further embodiment, the pump body includes a pair of spaced apart body magnets (permanent magnets) and the pump receiver includes a pair of spaced apart receiver magnets, wherein in the first orientation, the pair of spaced apart body magnets are aligned with the spaced apart receiver magnets and there is an attractive magnetic force between each pair of magnets, and in the second orientation, one of the body magnets is aligned with one of the receiver magnets, the other of the body magnets is out of alignment with the other of the other of the receiver magnets, and there is a repulsive magnetic force between the aligned magnets.

The skilled person will appreciate that the features described and defined in connection with the aspects of the invention and the embodiments thereof may be combined in any combination, regardless of whether the specific combination is expressly mentioned herein. Thus, combinations of optional features described and discussed herein are within the scope of the invention.

BRIEF DESCRIPTION OF THE DRAWINGS

An embodiment of the invention will now be described, by way of example only, with reference to the accompanying drawings in which.

DETAILED DESCRIPTION OF THE PREFERRED EMBODIMENTS

For the avoidance of doubt, the skilled person will appreciate that in this specification, the terms "up", "down", "front", "rear", "upper", "lower", "width", "above", "below", etc. refer to the orientation of the components of the invention when installed for normal use as shown in the Figures.

Figure 1:
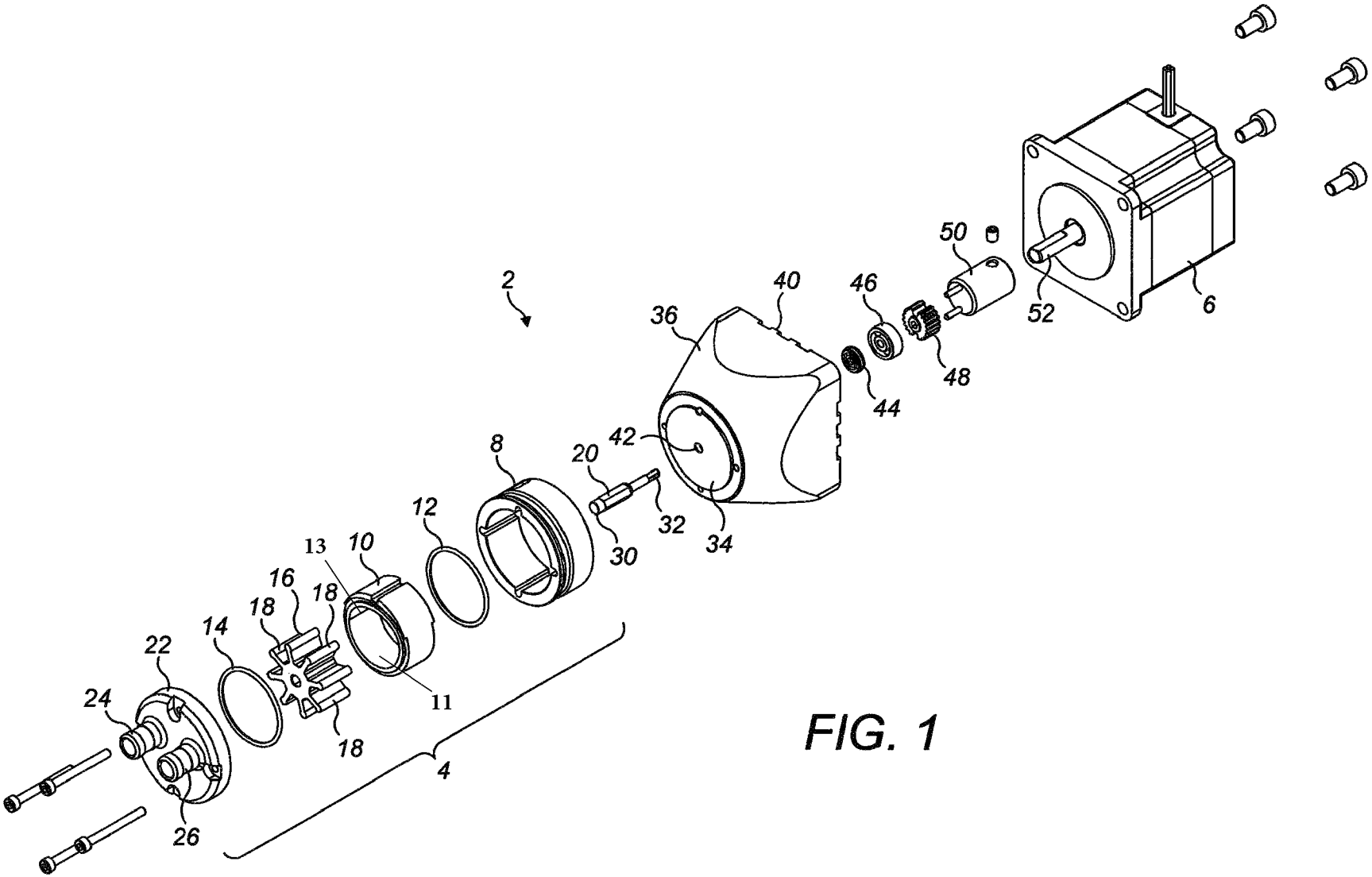
FIG. 1 is an exploded perspective view of a combination of a pump apparatus according to the first aspect of the invention with an electric motor.

FIG. 1 shows a combination 2 of a pump apparatus 4 and an electric motor 6. The pump apparatus 4 includes a pump body 8 within which is located a sleeve 10 that defines a pump chamber. O-ring seals 12, 14 provide a fluid tight seal between the sleeve 10 and end walls of the pump apparatus 4 (discussed below).

A flexible impeller 16 is located within the sleeve 10. The flexible impeller 16 includes eight flexible vanes 18, the ends of which wipe against the inwardly facing wall of the sleeve 10 in use. Such an arrangement defines eight pump cavities within the pump chamber, wherein each pump cavity is defined by an adjacent pair of the vanes 18 and the inwardly facing wall of the sleeve 10.

The flexible impeller 16 includes an insert element (not shown) at its core which defines a hexagonal shaped central channel. A drive shaft 20, which has a corresponding hexagonal shaped portion is located within the central channel, such that the flexible impeller 16 is rotationally locked to the drive shaft 20.

While the outwardly facing wall of the sleeve 10 has a circular cross-sectional shape, the inwardly facing wall has a first portion 11 which has a first radius and a second portion 13 which has a second, greater radius. This has the effect of providing the inwardly facing wall with a "flattened" portion (i.e. the second portion 13). As the flexible impeller 16 is driven to rotate by the drive shaft 20, the volume of the pump cavities decrease as they pass the "flattened" portion of the sleeve 10 (i.e. the second portion 13 of the inwardly facing wall of the sleeve). This decrease in pump cavity volume forces the fluid from the pump cavities.

The pump chamber defined by the sleeve 10 is closed at one end by an end plate 22. The end plate defines a fluid inlet port 24 which is aligned with the first portion of the sleeve 10 and a fluid outlet port 26 which is aligned with the second portion of the sleeve 10.

Figure 2:
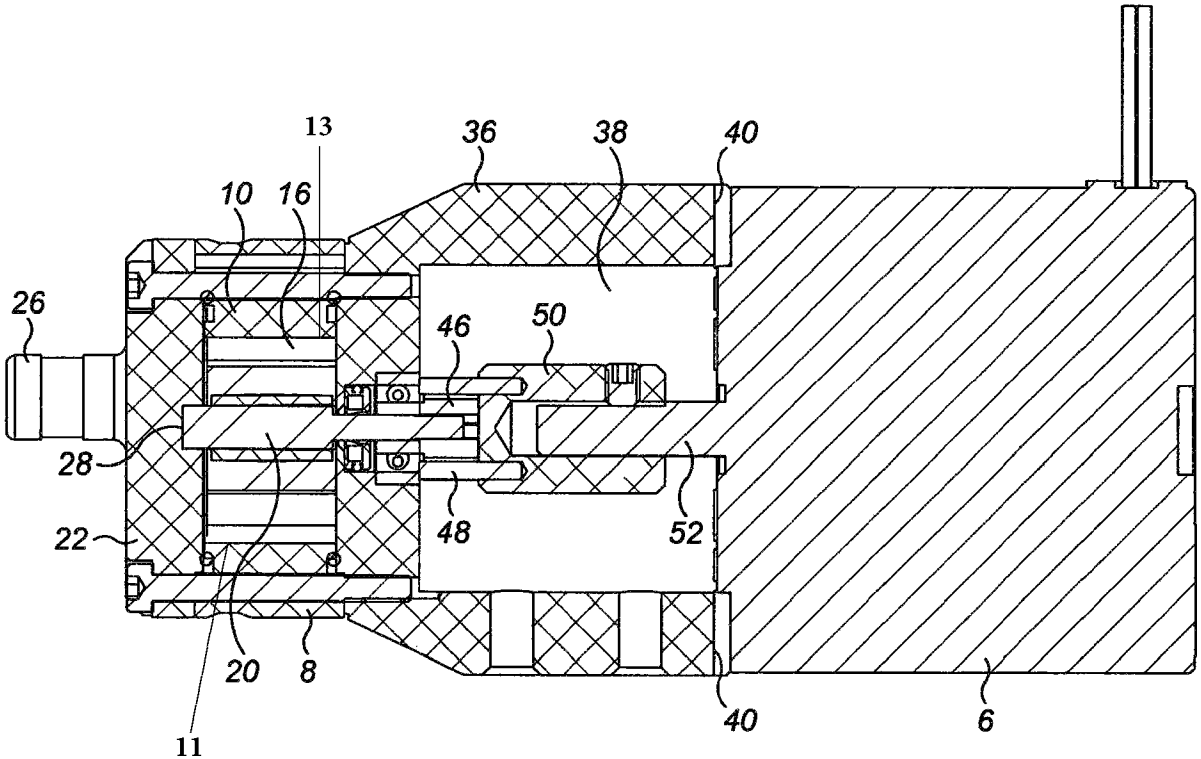
FIG. 2 is a sectional view through the combination shown in FIG. 1 in its assembled configuration.

The end plate 22 further defines a bearing portion 28, which is shown in more detail in FIG. 2. A distal end 30 of the drive shaft 20 is located within the bearing portion 28 and is rotatably supported by the bearing portion 28.

The opposite end of the pump chamber is closed by a closure portion 34 of a connector element 36. The connector element defines therein a cavity 38 and includes a mating surface 40, opposite to the closure portion 34, which permits the mating of the connector element 36 to the electric motor 6.

The drive shaft 20 extends through a channel 42 defined through the closure portion 34 of the connector element 36 and a proximal end 32 of the drive shaft 20 terminates in the cavity 38 defined by the connector element 36. A dynamic seal 44 and a support bearing 46 are coupled to the proximal portion 32 of the drive shaft 20. The dynamic seal 44 prevents fluid from within the pump chamber leaking through the closure portion 34 and the support bearing 46 supports the proximal end 32 of the drive shaft as it is rotated by the electric motor 6.

A first part 48 of a two-part connector is secured to the proximal end 32 of the drive shaft 20. The first part 48 of the two-part connector is engaged by a second part 50 of the two-part connector which is carried by an output shaft 52 of the electric motor 6.

Figure 3:
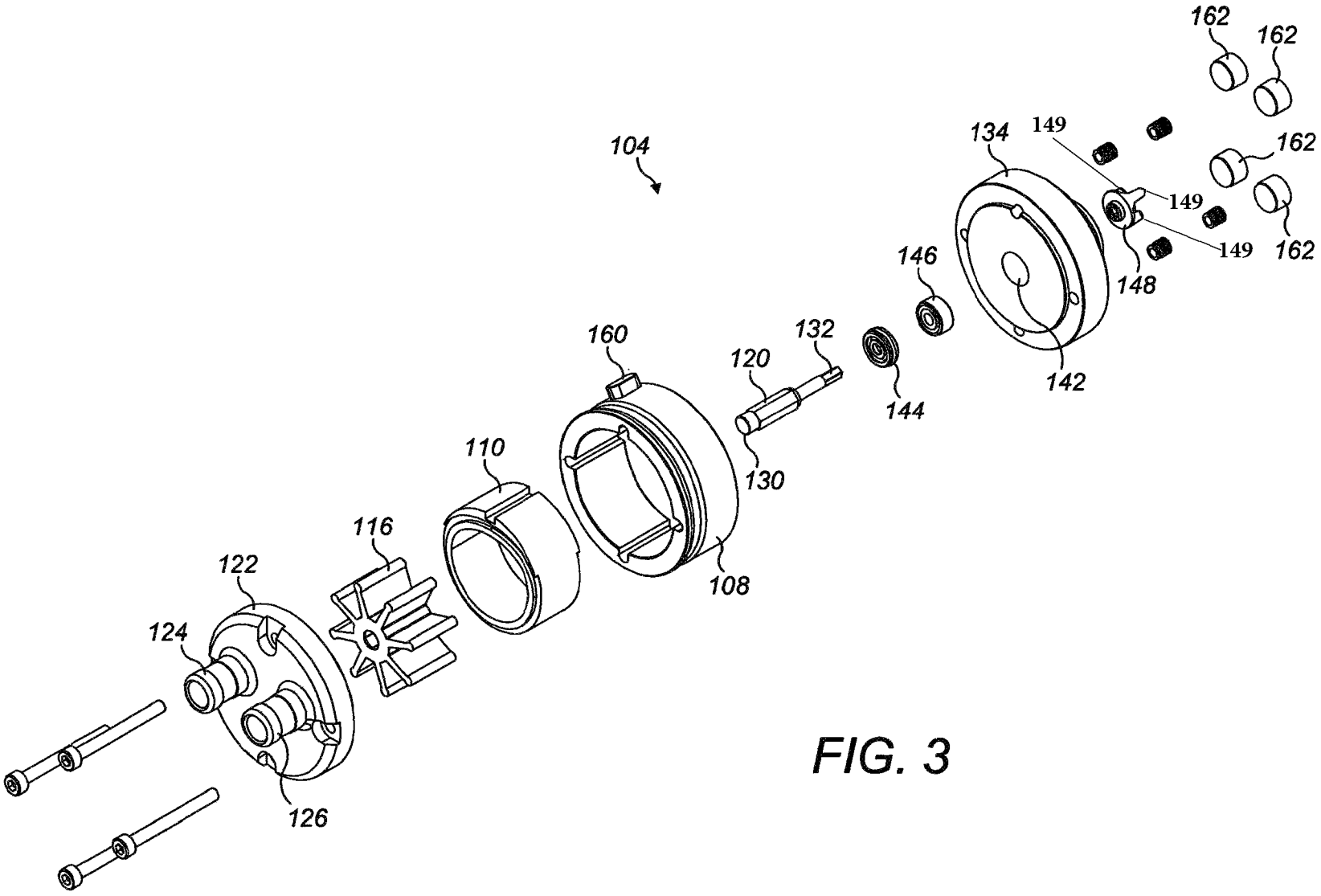
FIG. 3 is an exploded perspective view of a pump body according to the third aspect of the invention.

FIG. 3 shows a flexible impeller pump 104 which is similar to that described above in connection with FIGS. 1 and 2.

The pump 104 includes a pump body 108 within which is located a sleeve 110. The sleeve 110 has the same physical features as the sleeve 10 described above, but is formed from PTFE, which is a softer material, and as such, the pump 104 does not require O-ring seals to prevent fluid from within the pump chamber defined by the sleeve 110 leaking between the sleeve 110 and end plates 122, 134. A fluid-tight seal is formed between the sleeve 110 and the end plates 122, 134.

A flexible impeller 116, which is identical to the flexible impeller 16 described above, is located within the sleeve 110 and the flexible impeller is driven to rotate by a drive shaft 120 which is similar to the drive shaft 20 described above.

One end of the pump chamber defined by the sleeve 110 is closed by the end plate 122. Again, the end plate 122 is identical to the end plate 22 described above and it includes a fluid inlet port 124, a fluid outlet port 126 and a bearing portion (not shown in FIG. 3) which is shaped and configured to rotationally support a distal end 130 of the drive shaft 120.

A proximal end 132 of the drive shaft 120 also includes a dynamic seal 144 and a support bearing 146.

The pump 104 differs from that shown in FIGS. 1 and 2 in that the pump body 108 includes an alignment tab 160 and that the opposite end of the pump chamber is closed by the second end plate 134.

The drive shaft 120 passes through a channel 142 defined by the second end plate 134. In this embodiment, the support bearing 146 is located within the channel 142.

The proximal end 132 of the drive shaft 120 carries a first part 148 of a two part connector, which is discussed in more detail below.

On the opposite side of the second end plate (i.e. facing away from the pump chamber) is carried a first array of four permanent neodymium magnets 162.

Figure 4:
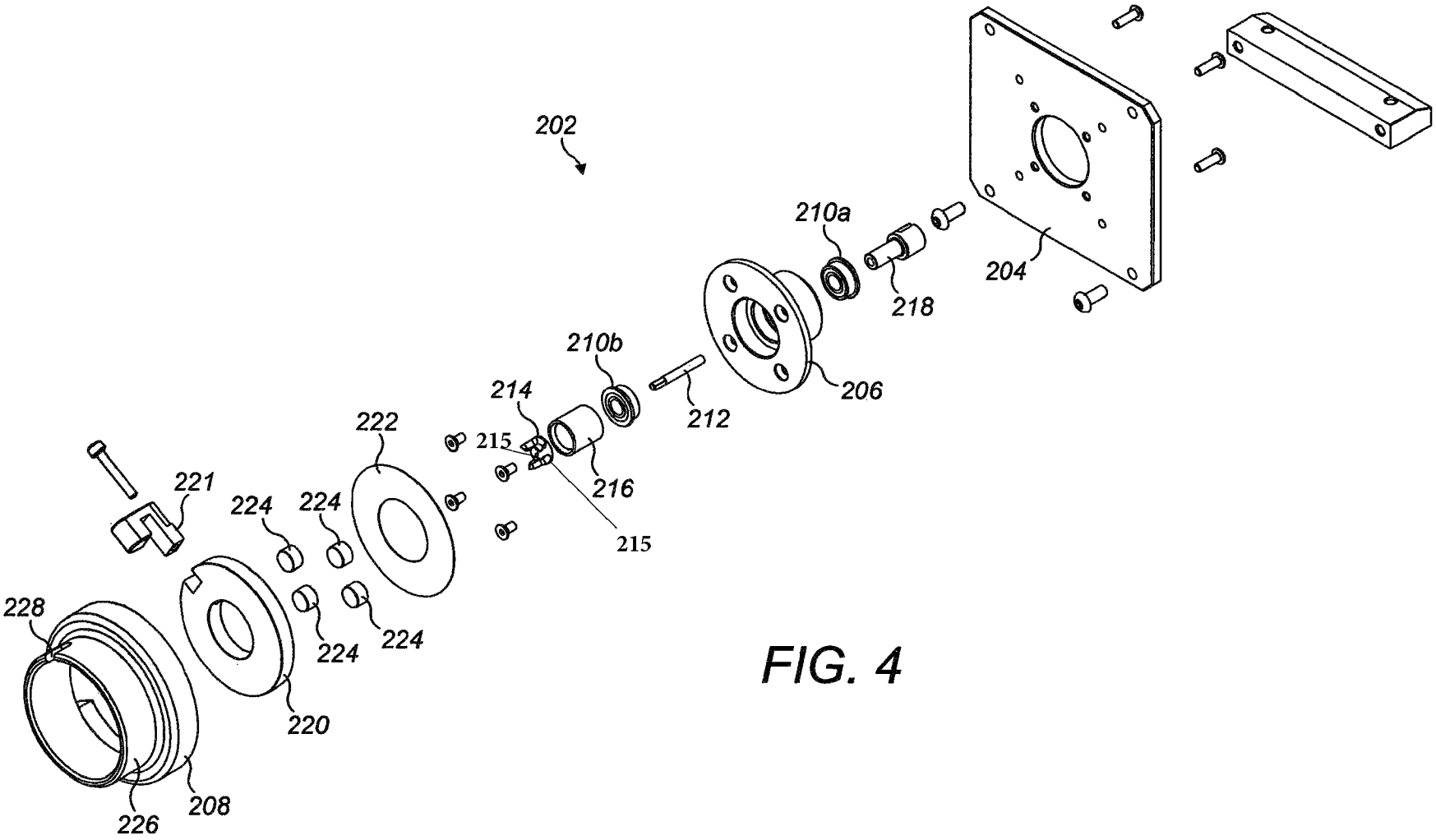
FIG. 4 is an exploded perspective view of a pump receiver according to the third aspect of the invention.

FIG. 4 shows a pump receiver 202 for magnetically receiving the pump 104 shown in FIG. 3.

The pump receiver 202 comprises a mounting plate 204 to which is fixed a bearing plate 206 and a pump receiving element 208.

The bearing plate 206 defines therethrough a channel within which is located a pair of support bearings 210*a*, 210*b* which rotationally support an auxiliary drive shaft 212. The auxiliary drive shaft passes through the channel defined by the bearing plate 206 and carries at its first end a second part 214 of the two-part connector which is spaced from the bearing plate by a cylindrical spacer 216.

The first part 148 of the two-part connector includes three radial ribs 149 arranged about a central axis. The ribs include sloped sides. The second part 214 of the two-part connector defines three channels 215 which correspond to the ribs 149 of the first part 148 and which also include sloped sides. The arrangement of the first and second parts 148, 214 of the two-part connector results in a self-aligning connector, as the ribs 149 will align themselves with the corresponding channels 215 as the first part 148 is moved towards the second part 214. The drive shaft 120 will be urged to rotate by the engagement of the sloped sides of the ribs 149 with the sloped sides of the channels 215 until the ribs 149 are aligned perfectly with the corresponding channels 215.

At its second end, the auxiliary drive shaft 212 carries a drive input connector 218 which may be connected to an output shaft of an electric motor (not shown).

Located between the bearing plate 206 and the pump receiving element 208 is a rotatable collar 220 which is rotatably coupled to the pump receiving element 208 such that it can rotate through an arc defined between stops (not shown). A first stop defines a first angular orientation of the rotatable collar 220 and a second stop defined a second angular orientation of the rotatable collar. The rotatable collar 220 further includes a manually operable tab 221.

Sandwiched between the rotatable collar 220 and a securing ring 222 is a second array of four permanent neodymium magnets 224.

The pump receiving element 208 includes a cylindrical body portion 226 which is open at one end to define an aperture which is configured to receive therein the pump body 108. The cylindrical body portion 226 defines therein a locating slot 228 which is sized and configured to receive therein the alignment tab 160 of the pump body 108. This ensures that the pump body 108 has a predetermined orientation relative to the pump receiving element 208 when the pump body is located within the cylindrical body portion 226.

In use, the rotatable collar 220 is arranged in its first orientation and the pump body 108 is located within the cylindrical body portion 226 with the alignment tab 160 located within the locating slot 228. With the rotatable collar 220 in its first orientation and the pump body correctly aligned within the pump receiving element 208, the first array of magnets 162 aligns with the second array of magnets 224 and a magnetic attraction force is generated between each of the magnets 162 and 224. In this arrangement, the removal of the pump 104 from the receiver 202 is resisted.

As the pump 104 is drawn into the receiver 202 by the magnetic attraction, the first part 148 of the two-part connector aligns automatically with the second part 214 of the two-part connector as discussed above. Thus, the drive shaft 120 is operatively coupled to the auxiliary drive shaft 212 and the drive shaft 120 may be driven by an electric motor when the auxiliary drive shaft 212 is coupled to an electric motor.

In order to detach the pump 104 from the receiver 202, the collar 220 is rotated to its second orientation via the tab 221. In this orientation, a first pair of the first magnets 162 are moved from alignment with a first pair of the second magnets 224 to alignment with a second pair of the second magnets 224. This results in the second pair of first magnets 162 and the first pair of the second magnets 224 no longer being in alignment with corresponding magnets. Furthermore, as the poles of the first pair of first magnets 162 and the second pair of second magnets are the same, a magnetic repulsive force urges the pump 104 away from the receiver 202.

The invention claimed is:

1. A pump apparatus comprising a pump chamber having a fluid inlet and a fluid outlet; and a flexible impeller mounted for rotation within the pump chamber, wherein the pump chamber is defined by a curved wall, the curved wall including a first wall portion having a first radius and a second wall portion having a second radius, wherein the second radius is greater than the first radius; the flexible impeller includes a plurality of radially extending vanes, wherein the plurality of radially extending vanes contact the curved wall of the pump chamber such that separate pump cavities are defined between adjacent vanes and the pump chamber wall; the flexible impeller is driven to rotate by a drive shaft; the drive shaft passes through a first end wall which closes one side of the pump chamber and a distal end of the drive shaft rotates within a bearing defined by a second end wall which closes the opposite side of the pump chamber, wherein the drive shaft is drivable by a motor; and wherein the fluid inlet and the fluid outlet are defined in the second end wall.

2. The pump apparatus according to claim 1, wherein the curved wall of the pump chamber is defined by a sleeve.

3. The pump apparatus according to claim 2, wherein the sleeve defines an outer wall having a circular cross-section and the sleeve is located within a pump body.

4. The pump apparatus according to claim 3, wherein a sealing element is provided between the sleeve and each of the first and second end walls.

5. The pump apparatus according to claim 1, wherein the pump apparatus further includes a connector which connects the pump apparatus to a motor.

6. The pump apparatus according to claim 5, wherein the connector defines the first end wall.

7. The pump apparatus according to claim 1, wherein the proximal end of the drive shaft includes a first part of a two-part coupling.

8. A combination of a pump apparatus according to claim 1 and an electric motor, wherein a rotary drive output from the electric motor is coupled to the drive shaft of the pump apparatus.

9. The combination according to claim 8, wherein one of the drive output from the electric motor and the drive shaft includes a first part of a two-part connector and the other of the drive output from the electric motor and the drive shaft includes a second part of the two-part connector.

10. A combination according to claim 9, wherein the first part of the two-part connector includes a rib and the second part of the two-part connector includes a channel having sloped sides such that the two-part connector is self-aligning.

11. A combination according to claim 10, wherein the first part of the two-part connector includes two or more ribs and the second part of the two-part connector includes a corresponding number of complementary channels.

12. A combination according to claim 11, wherein the pump apparatus is coupled to the electric motor via a connector.

* * * * *